US007549844B2

(12) United States Patent
Liang

(10) Patent No.: US 7,549,844 B2
(45) Date of Patent: Jun. 23, 2009

(54) TURBINE AIRFOIL COOLING SYSTEM WITH BIFURCATED AND RECESSED TRAILING EDGE EXHAUST CHANNELS

(75) Inventor: George Liang, Palm City, FL (US)

(73) Assignee: Siemens Energy, Inc., Orlando, FL (US)

( * ) Notice: Subject to any disclaimer, the term of this patent is extended or adjusted under 35 U.S.C. 154(b) by 397 days.

(21) Appl. No.: 11/509,231

(22) Filed: Aug. 24, 2006

(65) Prior Publication Data

US 2008/0050243 A1 Feb. 28, 2008

(51) Int. Cl.
*F01D 5/18* (2006.01)

(52) U.S. Cl. ..... 416/97 R; 415/177

(58) Field of Classification Search ..... 415/115; 416/97 R, 177

See application file for complete search history.

(56) References Cited

U.S. PATENT DOCUMENTS

| | | | | |
|---|---|---|---|---|
| 4,073,599 | A | 2/1978 | Allen et al. | |
| 4,526,512 | A | 7/1985 | Hook | |
| 4,930,980 | A | 6/1990 | North et al. | |
| 5,176,499 | A * | 1/1993 | Damlis et al. | 416/97 R |
| 5,813,827 | A | 9/1998 | Nordlund et al. | |
| 5,927,946 | A | 7/1999 | Lee | |
| 6,331,098 | B1 * | 12/2001 | Lee | 416/97 R |
| 6,471,479 | B2 | 10/2002 | Starkweather | |
| 6,499,949 | B2 | 12/2002 | Schafrik et al. | |
| 6,506,013 | B1 | 1/2003 | Burdgick et al. | |
| 6,517,312 | B1 | 2/2003 | Jones et al. | |
| 6,589,010 | B2 | 7/2003 | Itzel et al. | |
| 6,607,356 | B2 | 8/2003 | Manning et al. | |
| 6,761,534 | B1 | 7/2004 | Willett | |
| 6,957,949 | B2 | 10/2005 | Hyde et al. | |
| 6,981,840 | B2 * | 1/2006 | Lee et al. | 415/115 |
| 6,984,103 | B2 | 1/2006 | Lee et al. | |
| 7,125,225 | B2 * | 10/2006 | Surace et al. | 416/96 R |
| 7,255,535 | B2 * | 8/2007 | Albrecht et al. | 416/97 R |

FOREIGN PATENT DOCUMENTS

JP 04203203 A 7/1992

* cited by examiner

*Primary Examiner*—Ninh H Nguyen

(57) ABSTRACT

A cooling system for a turbine airfoil of a turbine engine having a trailing edge cooling channel with bifurcated exhaust channels formed by suction and pressure side trailing edge cooling channels in fluid communication with a central trailing edge cooling channel. The suction and pressure side trailing edge cooling channels may be separated with a trailing edge rib. The suction and pressure side trailing edge cooling channels may be recessed from the airfoil external surface to control the flow of cooling fluids from the cooling system such that the exhaust flow minimizes shear mixing and thus lowers the aerodynamic loss yet maintains high film cooling effectiveness for the airfoil trailing edge.

18 Claims, 4 Drawing Sheets

TURBINE AIRFOIL COOLING SYSTEM WITH BIFURCATED AND RECESSED TRAILING EDGE EXHAUST CHANNELS

FIELD OF THE INVENTION

This invention is directed generally to turbine airfoils, and more particularly to cooling systems in hollow turbine airfoils.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,500 degrees Fahrenheit. Typical turbine combustor configurations expose turbine blade assemblies to these high temperatures. As a result, turbine blades must be made of materials capable of withstanding such high temperatures. In addition, turbine blades often contain cooling systems for prolonging the life of the blades and reducing the likelihood of failure as a result of excessive temperatures.

Typically, turbine blades are formed from a root portion having a platform at one end and an elongated portion forming a blade that extends outwardly from the platform coupled to the root portion. The blade is ordinarily composed of a tip opposite the root section, a leading edge, and a trailing edge. The inner aspects of most turbine blades typically contain an intricate maze of cooling channels forming a cooling system. The cooling channels in a blade receive air from the compressor of the turbine engine and pass the air through the blade. The cooling channels often include multiple flow paths that are designed to maintain all aspects of the turbine blade at a relatively uniform temperature. However, centrifugal forces and air flow at boundary layers often prevent some areas of the turbine blade from being adequately cooled, which results in the formation of localized hot spots. Localized hot spots, depending on their location, can reduce the useful life of a turbine blade and can damage a turbine blade to an extent necessitating replacement of the blade.

Typically, the trailing edge of turbine airfoils develop hot spots. Trailing edges are thus often designed to be thin and include cooling channels that exhaust cooling cooling fluids from the pressure side of the trailing edge. This design minimizes the trailing edge thickness but creates shear mixing between the cooling air and the mainstream flow as the cooling air exits from the pressure side. The shear mixing of the cooling fluids with the mainstream flow reduces the cooling effectiveness of the trailing edge overhang and thus, induces over temperature at the airfoil trailing edge suction side location. Frequently, the hot spot developed in the trailing edge becomes the life limiting location for the entire airfoil. Thus, a need exists for a cooling system capable of providing sufficient cooling to trailing edge of turbine airfoils.

SUMMARY OF THE INVENTION

This invention relates to a turbine airfoil cooling system for a turbine airfoil used in turbine engines. In particular, the turbine airfoil cooling system may include one or more internal cavities positioned between outer walls of a generally elongated, hollow airfoil of the turbine airfoil. The cooling system may include one or more trailing edge cooling channels positioned within the generally elongated, hollow airfoil and proximate to a trailing edge and may be bifurcated and recessed from the airfoil external surface to minimize shear mixing at the trailing edge, thereby reducing aerodynamic loss while maintaining high film cooling effectiveness for the trailing edge. In at least one embodiment, the trailing edge cooling channel may include a central trailing edge cooling channel, a suction side trailing edge cooling channel extending from the central trailing edge cooling channel through the trailing edge, and a pressure side trailing edge cooling channel extending from the central trailing edge cooling channel through the trailing edge. The suction side trailing edge cooling chamber and the pressure side trailing edge cooling channel may be separated by a trailing edge rib forming the trailing edge and positioned in a general spanwise direction.

The turbine airfoil may be formed from a generally elongated, hollow airfoil formed by an outer wall and having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil positioned in internal aspects of the generally elongated, hollow airfoil. The suction side trailing edge cooling chamber and the pressure side trailing edge cooling channel may each include support ribs. The support ribs in the at least one pressure side trailing edge cooling channel may be aligned in a spanwise direction with the plurality of suction side chordwise support ribs in the suction side trailing edge cooling channel. In another embodiment, the plurality of pressure side chordwise support ribs in the pressure side trailing edge cooling channel may be offset in a spanwise direction from the plurality of suction side chordwise support ribs in the suction side trailing edge cooling channel.

A plurality of pin fins may be included in the central trailing edge cooling channel to increase the turbulence and cooling effectiveness of the central trailing edge cooling channel. The pin fins may extend from an inner surface of the outer wall forming the suction side to an inner surface of the outer wall forming the pressure side. The plurality of pin fins in the central trailing edge cooling channel may be aligned into rows extending in a spanwise direction.

The cavity in the elongated, hollow airfoil of the cooling system may include a serpentine cooling channel having an opening for receiving cooling fluids from a fluid supply source and includes at least one exhaust orifice in an internal rib for exhausting cooling fluids into the at least one trailing edge cooling channel. A plurality of trip strips may extend inwardly from inner surfaces of the outer wall forming the serpentine cooling channel. A leading edge cooling channel may be positioned proximate to the leading edge, extending generally spanwise to the leading edge, and in fluid communication with the at least one cavity forming the cooling system.

During use, cooling fluids may flow into the cooling system from a cooling fluid supply source. A portion of the cooling fluids may flow into the leading edge supply channel, through the supply orifices and into the leading edge cooling channel. The cooling fluids may then flow from the leading edge supply channel through film cooling holes forming a showerhead in the leading edge. The remaining portion of cooling fluids may flow from the cooling fluid supply source into the serpentine cooling channel. The cooling fluids may flow back and forth spanwise between the root to the tip section in the serpentine cooling channel. A portion of the cooling fluids in the serpentine cooling channel may be exhausted through the film cooling holes. The remaining portion of the cooling fluids may be passed through the one or more inlets into the central trailing edge cooling channel. The cooling fluids may then flow past the pin fins and around the trailing edge rib through either the suction or pressure side trailing edge cooling chambers. The cooling fluids may then be exhausted from the trailing edge of the elongated airfoil.

An advantage of this invention is that bifurcated trailing edge cooling channels exhaust cooling fluids from the trailing edge forming a concurrent cooling fluid flow that minimizes shear mixing between the cooling fluid and the mainstream flow, thereby enhancing the effectiveness of the airfoil trailing edge.

Another advantage of this invention is that bifurcated and recessed trailing edge cooling channels reduce the airfoil trailing edge thickness, thereby lowering the airfoil aerodynamic blockage and increase turbine stage performance and efficiency.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 1:
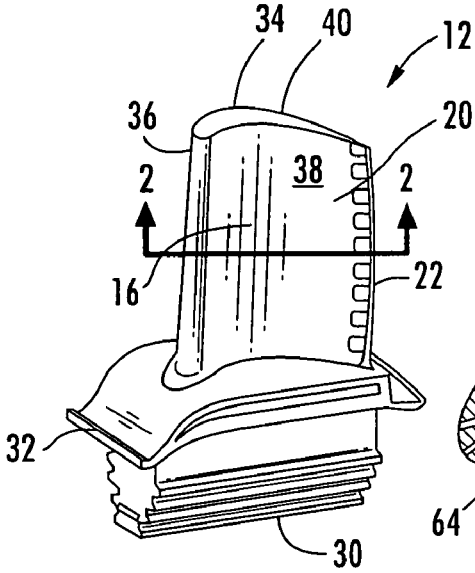
FIG. 1 is a perspective view of a turbine airfoil having features according to the instant invention.
Figure 2:
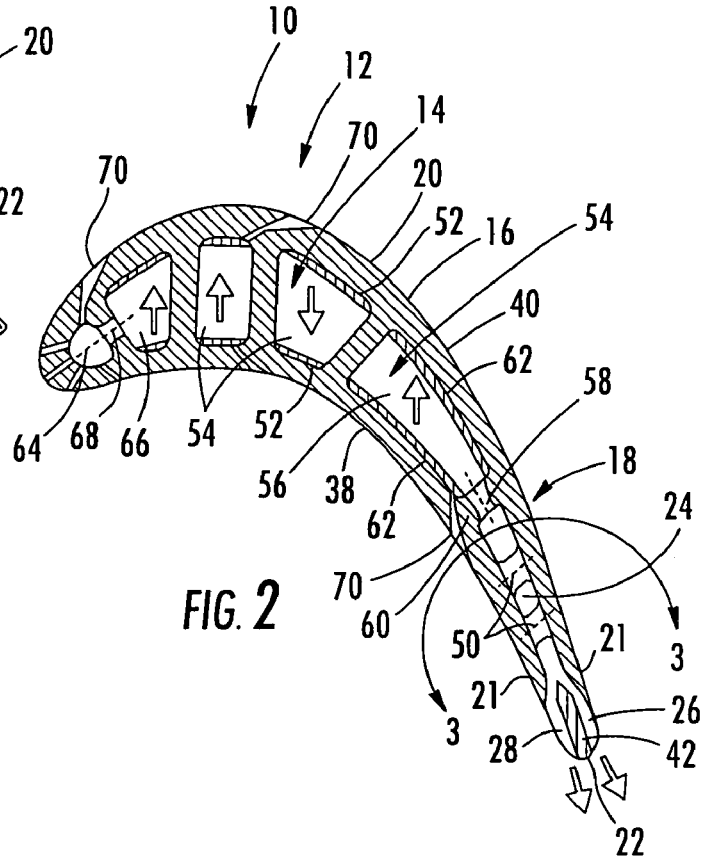
FIG. 2 is a cross-sectional view of the turbine airfoil shown in FIG. 1 taken along line 2-2.

As shown in FIGS. 1-5, this invention is directed to a turbine airfoil cooling system 10 for a turbine airfoil 12 used in turbine engines. In particular, the turbine airfoil cooling system 10 may include one or more internal cavities 14, as shown in FIG. 2, positioned between outer walls 16 of a generally elongated, hollow airfoil 20 of the turbine airfoil 12. The cooling system 10 may include one or more trailing edge cooling channels 18 positioned within the generally elongated, hollow airfoil 20. The trailing edge cooling channels 18 may be positioned proximate to a trailing edge 22 and may be bifurcated to minimize shear mixing at the trailing edge 22, thereby reducing aerodynamic loss while maintaining high film cooling effectiveness for the trailing edge 22. In at least one embodiment, the trailing edge cooling channel 18 may include a central trailing edge cooling channel 24, a suction side trailing edge cooling channel 26 extending from the central trailing edge cooling channel 24 through the trailing edge 22, and a pressure side trailing edge cooling channel 28 extending from the central trailing edge cooling channel 24 through the trailing edge 22. The suction side trailing edge cooling chamber 26 and the pressure side trailing edge cooling channel 28 may be separated by a trailing edge rib 42 forming the trailing edge and positioned in a general spanwise direction. The suction side trailing edge cooling chamber 26 and the pressure side trailing edge cooling channel 28 may be recessed from an outer surface 21 forming the trailing edge 22 to create space for the exhaust cooling fluids to collect. The trailing edge rib 42 forms the effective thickness of the trailing edge 22, as shown with arrows 76.

The turbine airfoil 12 may be formed from a generally elongated, hollow airfoil 20 coupled to a root 30 at a platform 32. The turbine airfoil 12 may be formed from conventional metals or other acceptable materials. The generally elongated airfoil 20 may extend from the root 30 to a tip section 34 and include a leading edge 36 and the trailing edge 22. Airfoil 20 may have an outer wall 16 adapted for use, for example, in a first stage of an axial flow turbine engine. Outer wall 16 may form a generally concave shaped portion forming a pressure side 38 and may form a generally convex shaped portion forming the suction side 40. The cavity 14, as shown in FIG. 2, may be positioned in inner aspects of the airfoil 20 for directing one or more gases, which may include air received from a compressor (not shown), through the airfoil 20 to reduce the temperature of the airfoil 20. The cavity 14 may be arranged in various configurations and is not limited to a particular flow path.

Figure 3:
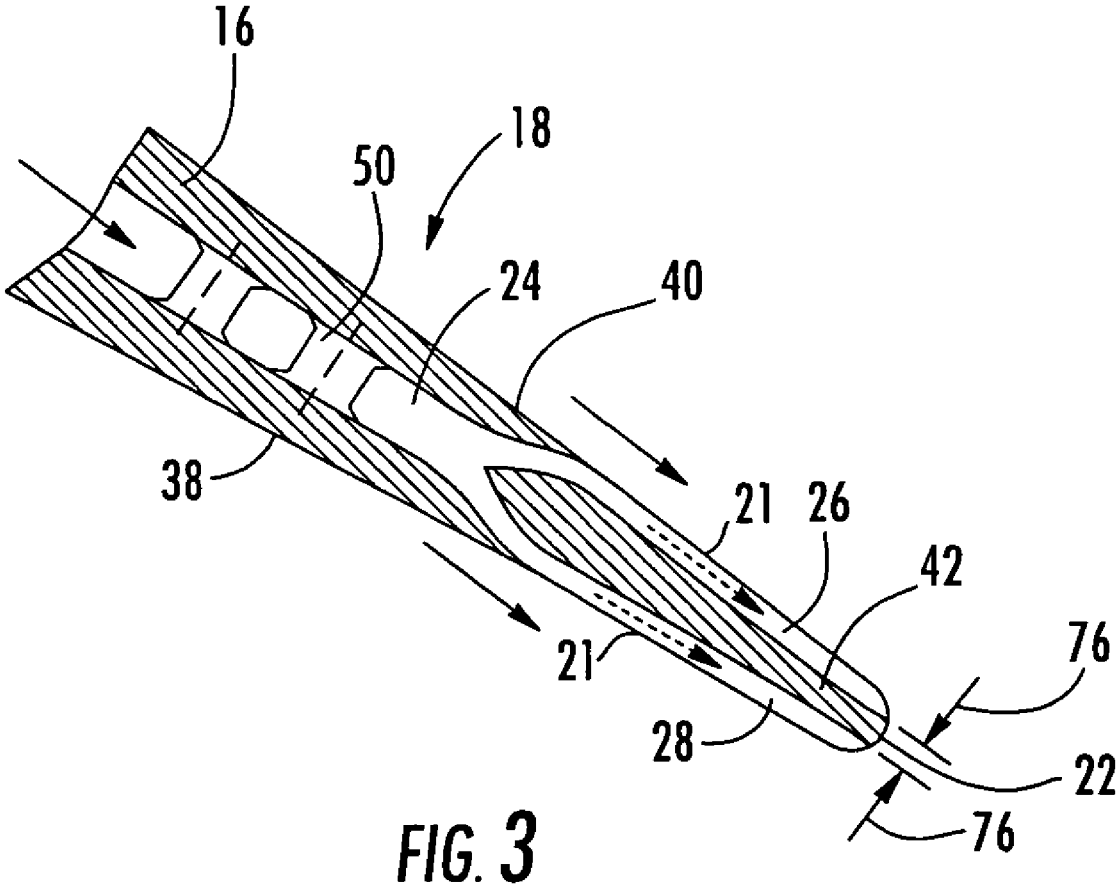
FIG. 3 is a detailed cross-sectional view of the trailing edge cooling chamber shown in FIG. 2 along line 3-3.

The cooling system 10, as shown in FIGS. 2-3, may include the trailing edge cooling channel 18 positioned within the generally elongated, hollow airfoil 20 and proximate to the trailing edge 22. The at least one trailing edge cooling channel 18 may include the central trailing edge cooling channel 24, one or more suction side trailing edge cooling channels 26 extending from the central trailing edge cooling channel 24 through the trailing edge 22, and one or more pressure side trailing edge cooling channels 28 extending from the central trailing edge cooling channel 24 through the trailing edge 22. The suction side trailing edge cooling chamber 26 and the pressure side trailing edge cooling channel 28 may be recessed from an outer surface 21 forming the trailing edge 22 to create space for the exhaust cooling fluids to collect. By recessing the suction and pressure side trailing edge cooling channels 26, 28 into the airfoil 20, additional space may be created for the cooling fluids being exhausted from the airfoil 20 to reduce turbulence in the film cooling. The suction side trailing edge cooling channel 26 and the pressure side trailing edge cooling channel 28 may be separated by a trailing edge rib 42 forming the trailing edge 22 and positioned in a general spanwise direction.

Figure 4:
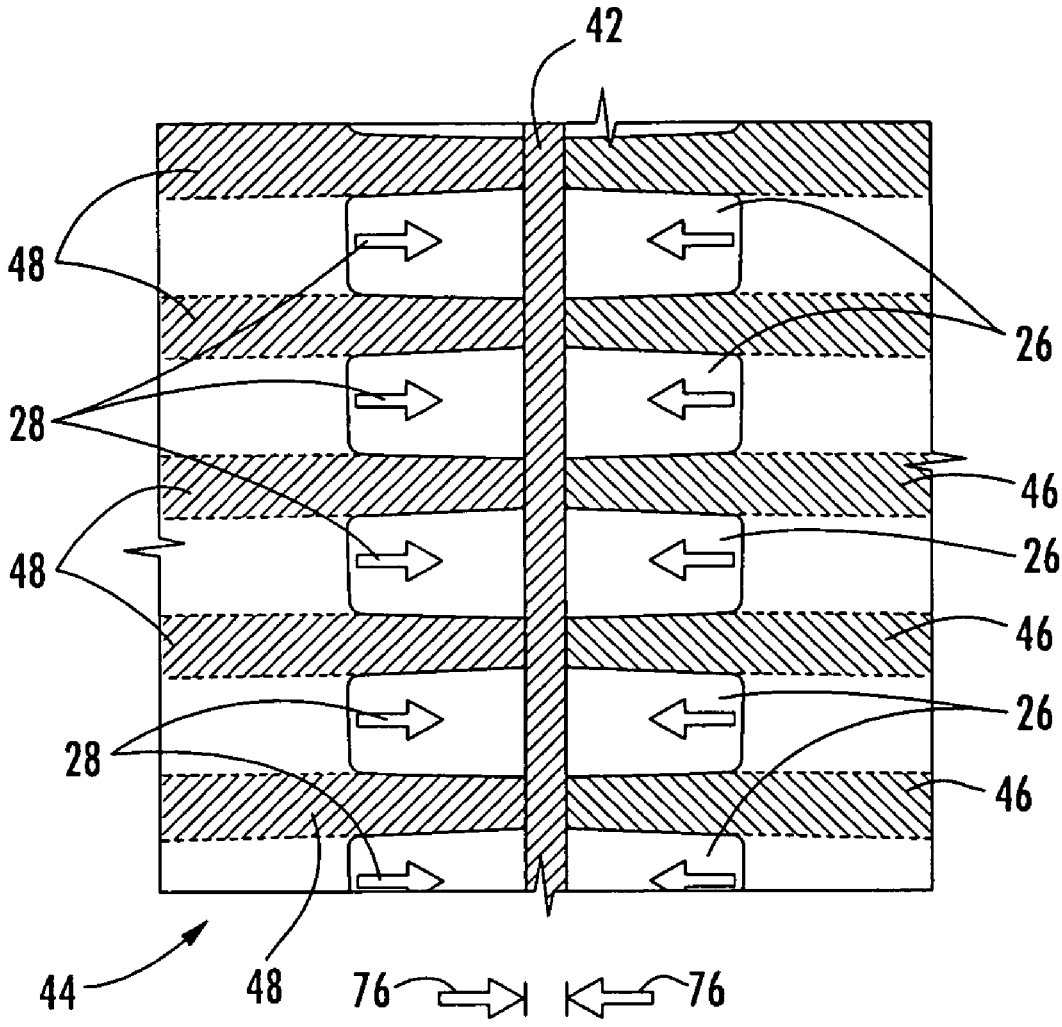
FIG. 4 is a partial front view of the trailing edge looking chordwise taken at line 4-4 in FIG. 1.
Figure 5:
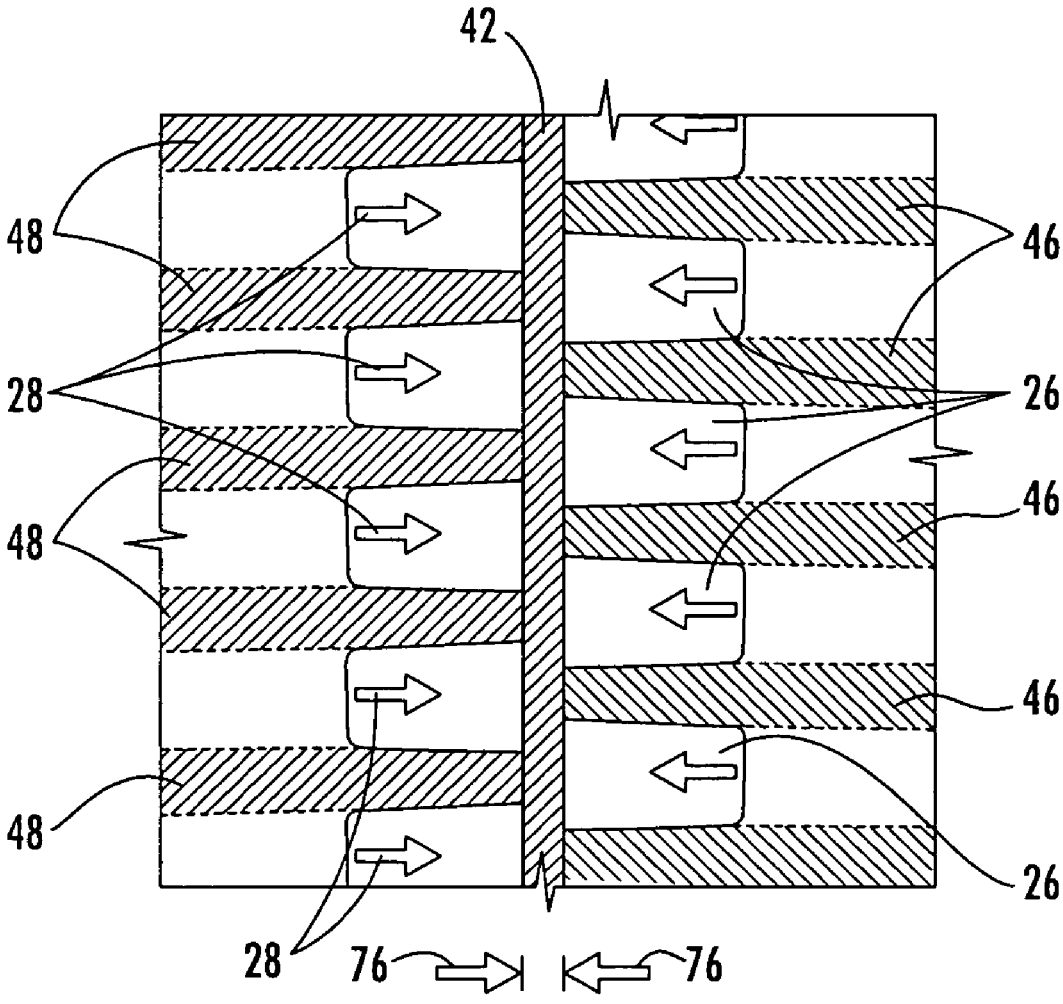
FIG. 5 is a partial front view of an alternative embodiment of the trailing edge looking chordwise taken at line 4-4 in FIG. 1.

The cooling system 10 may also include one or more chordwise support ribs 44 extending chordwise from the outer wall 16 into contact with the trailing edge rib 42. In at least one embodiment, the cooling system 10 may include a plurality of chordwise support ribs 44. The plurality of chordwise support ribs 44 may include one or more suction side chordwise support ribs 46 positioned in the suction side trailing edge cooling channel 26. Similarly, the plurality of chordwise support ribs 44 may include one or more pressure side chordwise support ribs 48 positioned in the pressure side trailing edge cooling channel 28. As shown in FIG. 4, the pressure side chordwise support ribs 48 in the pressure side trailing edge cooling channel 28 may be aligned in a spanwise direction with the plurality of suction side chordwise support ribs 46 in the suction side trailing edge cooling channel 26. In another embodiment, as shown in FIG. 5, the pressure side chordwise support ribs 48 in the pressure side trailing edge cooling channel 28 may be offset in a spanwise direction from the suction side chordwise support ribs 46 in the suction side trailing edge cooling channel 26.

The cooling system 10 may also include a plurality of pin fins 50 in the central trailing edge cooling channel 24. The pin fins 50 may extend from an inner surface 52 of the outer wall 16 forming the suction side 40 to an inner surface 52 of the outer wall 16 forming the pressure side 38. The pin fins 50 in the central trailing edge cooling channel 24 may be aligned into rows extending in a spanwise direction. The pin fins 50 within the rows may be aligned or offset in the spanwise direction from each other.

The cooling system 10 may also include a serpentine cooling channel 54 positioned within central aspects of the elongated airfoil 20. The serpentine cooling channel 54 may include an opening 56 for receiving cooling fluids from a fluid supply source and may include an exhaust orifice 58 in an internal rib 60 for exhausting cooling fluids into the trailing edge cooling channel 18. The serpentine cooling channel 54 may be formed from three legs, as shown in FIG. 2, or in other number of legs. The serpentine cooling channel 54 may also include one or more trip strips 62 extending inwardly from inner surfaces 52 of the outer wall 16 forming the serpentine cooling channel 54. The trip strips 62 may be orthogonal to the flow of cooling fluids through the channels or may be positioned at other angles.

The cooling system 10 may include one or more leading edge cooling channels 64 positioned proximate to the leading edge 36. The leading edge cooling chamber 64 may extend generally spanwise and along the leading edge 36. The leading edge cooling chamber may be in fluid communication with the cavity 14 forming the cooling system 10 and in particular, may be in contact with a leading edge supply channel 66 through one or more supply orifices 68.

During use, cooling fluids may flow into the cooling system 10 from a cooling fluid supply source. A portion of the cooling fluids may flow into the leading edge supply channel 66, through the supply orifices 68 and into the leading edge cooling channel 64. The cooling fluids may then flow from the leading edge supply channel 66 through film cooling holes 70 forming a showerhead in the leading edge 36. The remaining portion of cooling fluids may flow from the cooling fluid supply source into the serpentine cooling channel 54. The cooling fluids may flow back and forth spanwise between the root 30 to the tip section 34 in the serpentine cooling channel 54. A portion of the cooling fluids in the serpentine cooling channel 54 may be exhausted through the film cooling holes 70. The remaining portion of the cooling fluids may be passed through the one or more exhaust orifices 58 into the central trailing edge cooling channel 24. The cooling fluids may then flow past the pin fins 50 and around the trailing edge rib 42 through either the suction or pressure side trailing edge cooling chambers 26, 28. The cooling fluids may then be exhausted from the trailing edge 22 of the elongated airfoil 20.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil, comprising:

a generally elongated, hollow airfoil formed by an outer wall and having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil positioned in internal aspects of the generally elongated, hollow airfoil;

at least one trailing edge cooling channel positioned within the generally elongated, hollow airfoil and proximate to the trailing edge, wherein the at least one trailing edge cooling channel comprises a central trailing edge cooling channel, at least one suction side trailing edge cooling channel extending from the central trailing edge cooling channel through the trailing edge, and at least one pressure side trailing edge cooling channel extending from the central trailing edge cooling channel through the trailing edge;

wherein the at least one suction side trailing edge cooling channel and the at least one pressure side trailing edge cooling channel are separated by a trailing edge rib forming the trailing edge and positioned in a general spanwise direction and the at least one suction side trailing edge cooling channel and the at least one pressure side trailing edge cooling channel are recessed from an outer surface forming the trailing edge; and a plurality of chordwise support ribs extending chordwise from the outer wall into contact with the trailing edge rib.

2. The turbine airfoil of claim 1, wherein the plurality of chordwise support ribs form a plurality of suction side chordwise support ribs positioned in the at least one suction side trailing edge cooling channel.

3. The turbine airfoil of claim 2, wherein the plurality of chordwise support ribs form a plurality of pressure side chordwise support ribs positioned in the at least one pressure side trailing edge cooling channel.

4. The turbine airfoil of claim 3, wherein the plurality of chordwise support ribs in the at least one pressure side trauma edge cooling channel are aligned in a spanwise direction with the plurality of chordwise support ribs in the at least one suction side trailing edge cooling channel.

5. The turbine airfoil of claim 3, wherein the plurality of chordwise support ribs in the at least one pressure side trailing edge cooling channel are offset in a spanwise direction from the plurality of chordwise support ribs in the at least one suction side trailing edge cooling channel.

6. The turbine airfoil of claim 1, further comprising a plurality of pin fins in the central trailing edge cooling channel and extending from an inner surface of the outer wall forming the suction side to an inner surface of the outer wall forming the pressure side.

7. The turbine airfoil of claim 1, wherein the at least one cavity in the elongated, hollow airfoil of the cooling system comprises a serpentine cooling channel having an opening for receiving cooling fluids from a fluid supply source and includes at least one exhaust orifice in an internal rib for exhausting cooling fluids into the at least one trailing edge cooling channel.

8. The turbine airfoil of claim 7, further comprising a plurality of trip strips extending inwardly from inner surfaces of the outer wall forming the serpentine cooling channel.

9. The turbine airfoil of claim 6, wherein the plurality of pin fins in the central trailing edge cooling channel are aligned into rows extending in a spanwise direction.

10. The turbine airfoil of claim 1, further comprising at least one leading edge cooling channel positioned proximate to the leading edge, extending generally spanwise to the leading edge, and in fluid communication with the at least one cavity forming the cooling system.

11. A. turbine airfoil, comprising:

a generally elongated, hollows airfoil formed by an outer wall and having a leading edge, a trailing edge, a tip section at a first end, a root coupled to the airfoil at an end generally opposite the first end for supporting the airfoil and for coupling the airfoil to a disc, and a cooling system formed from at least one cavity in the elongated, hollow airfoil positioned in internal aspects of the generally elongated, hollow airfoil;

at least one trailing edge cooling channel positioned within the generally elongated, hollow airfoil and proximate to the trailing edge, wherein the at least one trailing edge cooling channel comprises a central trailing, edge cooling channel, at least one suction side trailing edge cooling channel extending from the central trailing edge cooling channel through the trailing edge, and at least one pressure side trailing edge cooling channel extending from the central trailing edge cooling channel through the trailing edge;

wherein the at least one suction side trailing edge cooling channel and the at least one pressure side trailing edge cooling channel are separated by a trailing edge rib forming the trailing edge and positioned in a general spanwise direction;

wherein the at least one suction side trailing edge cooling channel and the at least one pressure side trailing edge cooling channel are recessed from an outer surface forming the trailing edge;

a plurality of suction side chordwise support ribs positioned in the at least one suction side trailing edge cooling channel; and a plurality of pressure side chordwise support ribs positioned in the at least one pressure side trailing edge cooling channel.

12. The turbine airfoil of claim 11, wherein the plurality of pressure side chordwise support ribs in the at least one pressure side trailing edge cooling channel are aligned in a spanwise direction with the plurality of suction side chordwise support ribs in the at least one suction side trailing edge cooling channel.

13. The turbine airfoil of claim 11, wherein the plurality of pressure side chordwise support ribs in the at least one pressure side trailing edge cooling channel are offset in a spanwise direction from the plurality of suction side chordwise support ribs in the at least one suction side trailing edge cooling channel.

14. The turbine airfoil of claim 11, further comprising a plurality of pin fins in the central trailing edge cooling channel and extending from an inner surface of the outer wall forming the suction side to an inner surface of the outer wall forming the pressure side.

15. The turbine airfoil of claim 11, wherein the plurality of pin fins in the central trailing edge cooling channel are aligned into rows extending in a spanwise direction.

16. The turbine airfoil of claim 11, wherein the at least one cavity in the elongated, hollow airfoil of the cooling system comprises a serpentine cooling channel having an opening for receiving cooling fluids from a fluid supply source and includes at least one exhaust orifice in an internal rib for exhausting cooling fluids into the at least one trailing edge cool big channel.

17. The turbine airfoil of claim 16, further comprising a plurality of trip strips extending inwardly from inner surfaces of the outer wall forming the serpentine cooling channel.

18. The turbine airfoil of claim 11, further comprising at least one leading edge cooling channel positioned proximate to the leading edge, extending generally spanwise to the leading edge and in fluid communication with the at least one cavity forming the cooling system.

* * * * *